US008494200B2

(12) United States Patent
Ram et al.

(10) Patent No.: US 8,494,200 B2
(45) Date of Patent: Jul. 23, 2013

(54) HEARING AID MICROPHONE PROTECTIVE BARRIER

(75) Inventors: Sunder Ram, San Jose, CA (US); Dean Johnson, Solana Beach, CA (US); Richard Gable, Sunnyvale, CA (US); Michael Ipsen, Redwood City, CA (US); Ian M. Day, Fremont, CA (US)

(73) Assignee: InSound Medical, Inc., Newark, CA (US)

( * ) Notice: Subject to any disclaimer, the term of this patent is extended or adjusted under 35 U.S.C. 154(b) by 171 days.

(21) Appl. No.: 12/969,362

(22) Filed: Dec. 15, 2010

(65) Prior Publication Data

US 2011/0085688 A1 Apr. 14, 2011

Related U.S. Application Data

(62) Division of application No. 11/427,500, filed on Jun. 29, 2006, now Pat. No. 7,876,919.

(60) Provisional application No. 60/696,265, filed on Jun. 30, 2005.

(51) Int. Cl.
*H04R 25/00* (2006.01)

(52) U.S. Cl.
USPC ..... 381/328; 381/322; 381/324

(58) Field of Classification Search
USPC ..... 381/322, 324–325, 327–328, 380–381, 381/355, 360, 369; 181/129–131, 135
See application file for complete search history.

(56) References Cited

U.S. PATENT DOCUMENTS

| | | | |
|---|---|---|---|
| 3,061,689 | A | 10/1962 | McCarrell et al. |
| RE26,258 | E | 8/1967 | Martin |
| 3,414,685 | A | 12/1968 | Geib et al. |
| 3,527,901 | A | 9/1970 | Geib |
| 3,594,514 | A | 7/1971 | Wingrove |
| 3,764,748 | A | 10/1973 | Branch et al. |
| 3,783,201 | A | 1/1974 | Weiss et al. |
| 3,865,998 | A | 2/1975 | Weiss et al. |
| 3,870,832 | A | 3/1975 | Fredrickson |
| 3,882,285 | A | 5/1975 | Nunley et al. |
| 4,424,419 | A | 1/1984 | Chaput et al. |

(Continued)

FOREIGN PATENT DOCUMENTS

WO WO 97/09864 3/1997

OTHER PUBLICATIONS

US 5,730,699, 3/1998, Adams et al. (withdrawn).

*Primary Examiner* — Suhan Ni
(74) *Attorney, Agent, or Firm* — Henricks, Slavin & Holmes LLP

(57) ABSTRACT

Embodiments of the invention provide microphone assemblies for hearing aids which are resistant to moisture and debris. An embodiment provides a microphone assembly for a CIC hearing aid comprising a microphone housing including a housing surface having a microphone port, a fluidic barrier structure coupled to the housing surface, a protective mesh coupled to the barrier structure and a microphone disposed within the housing. The microphone housing can be sized to be positioned in close proximity to another component surface such as a hearing battery assembly surface. At least a portion of the housing surface and/or the barrier structure are hydrophobic. The barrier structure surrounds the microphone port and is configured to channel liquid and debris away from entry into the microphone port including matter constrained between the housing surface and another surface.

27 Claims, 16 Drawing Sheets

U.S. PATENT DOCUMENTS

| | | | | |
|---|---|---|---|---|
| 4,505,329 | A | | 3/1985 | Nguyen-Thanh |
| 4,539,440 | A | | 9/1985 | Sciarra |
| 4,607,720 | A | | 8/1986 | Hardt |
| 4,628,907 | A | | 12/1986 | Epley |
| 4,639,556 | A | | 1/1987 | Hartl et al. |
| 4,680,799 | A | | 7/1987 | Henneberger |
| 4,756,312 | A | | 7/1988 | Epley |
| 4,776,322 | A | | 10/1988 | Hough et al. |
| 4,817,607 | A | | 4/1989 | Tatge |
| 4,830,139 | A | | 5/1989 | Cirillo |
| 4,840,178 | A | | 6/1989 | Heide et al. |
| 4,870,688 | A | | 9/1989 | Voroba et al. |
| 4,870,689 | A | | 9/1989 | Weiss |
| 4,880,076 | A | | 11/1989 | Ahlberg et al. |
| 4,920,564 | A | | 4/1990 | Allkins |
| 4,937,876 | A | | 6/1990 | Biermans |
| 4,957,478 | A | | 9/1990 | Maniglia |
| 4,987,597 | A | | 1/1991 | Haertl |
| 5,002,151 | A | | 3/1991 | Oliveira et al. |
| 5,015,224 | A | | 5/1991 | Maniglia |
| 5,015,225 | A | | 5/1991 | Hough et al. |
| 5,163,957 | A | | 11/1992 | Sade et al. |
| 5,220,918 | A | | 6/1993 | Heide et al. |
| 5,222,050 | A | | 6/1993 | Marren et al. |
| 5,259,032 | A | | 11/1993 | Perkins et al. |
| 5,282,858 | A | | 2/1994 | Bisch et al. |
| 5,338,287 | A | | 8/1994 | Miller et al. |
| 5,390,254 | A | | 2/1995 | Adelman |
| 5,425,104 | A | | 6/1995 | Shennib |
| 5,456,654 | A | | 10/1995 | Ball |
| 5,530,763 | A | * | 6/1996 | Aebi et al. ..... 381/322 |
| 5,531,787 | A | | 7/1996 | Lesinski et al. |
| 5,554,096 | A | | 9/1996 | Ball |
| 5,624,376 | A | | 4/1997 | Ball et al. |
| 5,654,530 | A | | 8/1997 | Sauer et al. |
| 5,659,621 | A | | 8/1997 | Newton |
| 5,682,020 | A | | 10/1997 | Oliveira |
| 5,701,348 | A | | 12/1997 | Shennib et al. |
| 5,712,918 | A | | 1/1998 | Yoest |
| 5,742,692 | A | | 4/1998 | Garcia et al. |
| 5,833,626 | A | | 11/1998 | Leysieffer |
| 5,864,628 | A | * | 1/1999 | Posen et al. ..... 381/325 |
| 6,058,198 | A | | 5/2000 | Aceti |
| 6,134,333 | A | * | 10/2000 | Flagler ..... 381/325 |
| 6,208,741 | B1 | | 3/2001 | Shennib et al. |
| 6,212,283 | B1 | | 4/2001 | Fletcher et al. |
| 6,408,081 | B1 | | 6/2002 | Boesen |
| 6,505,076 | B1 | | 1/2003 | Tziviskos et al. |
| 6,595,796 | B1 | | 7/2003 | Koegel et al. |
| 6,620,110 | B2 | | 9/2003 | Schmid |
| 6,643,378 | B2 | | 11/2003 | Schumaier |
| 6,648,813 | B2 | | 11/2003 | Zilberman et al. |
| 6,658,126 | B1 | | 12/2003 | Stern |
| 6,795,562 | B1 | | 9/2004 | Gunnersen et al. |
| 7,313,245 | B1 | * | 12/2007 | Shennib ..... 381/325 |
| 7,876,919 | B2 | | 1/2011 | Ram et al. |
| 2003/0198360 | A1 | | 10/2003 | Niederdrank |

* cited by examiner

HEARING AID MICROPHONE PROTECTIVE BARRIER

CROSS-REFERENCES TO RELATED APPLICATIONS

This application is a divisional of U.S. patent application Ser. No. 11/427,500, filed Jun. 29, 2006, which claims the benefit of priority of U.S. Provisional Application Ser. No. 60/696,265, filed on Jun. 30, 2005, the full disclosures of which are incorporated herein by reference.

This application is also related to U.S. Provisional Application Ser. No. 60/696,276, entitled, Hearing Aid Battery Barrier, filed on Jun. 30, 2005; and U.S. patent application Ser. No. 11/058,097 entitled, Perforated Cap Assembly for a Hearing Aid, filed on Feb. 14, 2005, the full disclosure of each being incorporated herein by reference.

BACKGROUND OF THE INVENTION

Field of the Invention

Embodiments of the invention relate to hearing aids. More specifically, embodiments of the invention relate to moisture/debris protective structures for microphone components used in hearing aids including completely in the canal hearing aids.

Since many hearing aid devices are adapted to be fit into the ear canal, a brief description of the anatomy of the ear canal will now be presented. While, the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

First generation hearing devices were primarily of the Behind-The-Ear (BTE) type. However they have been largely replaced by In-The-Canal hearing devices are of which there are three types. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. These devices fit deep within the ear canal and can be essentially hidden from view from the outside.

In addition to the obvious cosmetic advantages, CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

However despite their advantages, many completely CIC hearing devices have performance and reliability issues relating to occlusion effects and the exposure of their components to moisture, cerumen, perspiration and other contaminants entering the ear canal (e.g. soap, pool water, etc.). Attempts have been made to use filters to protect key components such as the sound ports of the microphone. However over time, the filters can become clogged with cerumen, and other contamination. In particular, as the filters are exposed to contaminating fluids, the fluids and other contaminants are absorbed by the filter, clogging the filter pores preventing or otherwise attenuating sound reaching the microphone. Part of the problem is attributable to the surface structure of the filter and/or microphone port surface which encourages fluid absorption on to the filter and/or microphone surface due to capillary action. The use of low surface energy coatings can reduce the amount of capillary action and will cause fluids to ball up on the surface rather than spread over it. However, such coatings cause the fluid droplets to seek out and flow into surface deformities, such as the microphone port, which due to their surface irregularities, exert adhesive forces on the fluids droplets and disrupt the cohesive forces keeping the droplet together. Such deformity attraction also occurs and may be accentuated when the fluid droplet is located between two flat surfaces a configuration which may occur in various hearing designs due to special constraints. There is a need for improved sealing and moisture protection methodologies for hearing aid components including hearing aid microphones.

BRIEF SUMMARY OF THE INVENTION

Embodiments of the invention provide devices, assemblies and methods for improving the moisture and debris resistance of hearing aid microphones and other electronic components used in completely in the canal (CIC) hearing aids. One embodiment provides a microphone assembly for a CIC hearing aid including a hydrophobic coated surface having a microphone port and a hydrophobic coated ring positioned around the port. The ring is configured as a fluidic barrier structure to channel water, liquid droplets and debris around the port such that water and contaminants do not contact or enter the port. The microphone assembly can be configured to be positioned adjacent another flat surface such as the surface on a battery assembly or barrier surface on the battery.

Another embodiment provides a microphone assembly for a CIC hearing aid comprising a microphone housing including a housing surface having a microphone port, a fluidic barrier structure coupled to the housing surface, a protective porous mesh coupled to the barrier structure and a microphone disposed within the housing. The microphone housing can be sized to be positioned in close proximity to another component surface such as a hearing battery assembly surface. At least a portion of the housing surface and/or the barrier structure can be hydrophobic. Those portions can comprise hydrophobic coatings such as fluoro-polymer or parylene. The barrier structure surrounds the microphone port and is configured to channel liquid and debris away from entry into the microphone port including liquid constrained between the housing surface and another surface. The barrier structure can have a variety of shapes. In one embodiment, the barrier structure is square shaped and has a rectangular or square cross section. Alternatively, it can be ring shaped and has a circular cross section area. Preferably, the area of the barrier structure is maximized relative to the area of the housing surface. The mesh has a pore size configured to substantially prevent entry of cerumen particles into the port while minimizing detrimental effect to a hearing aid performance parameter when the mesh is greater than about 25% patent. These performance parameters can include the output, volume, gain or frequency response of the hearing aid.

In many embodiments, the barrier structure is configured to hold the mesh at an offset from the housing surface such that there is a gap between the barrier surface and the mesh. The offset defines an air volume to conduct sound to the microphone port. Also the air volume provides a plurality of pathways for acoustical conduction to the microphone port. The plurality of pathways can maintain a level of acoustical conduction to the port when up to about 75% of the mesh is occluded.

Another embodiment provides a CIC hearing aid device for operation in the bony portion of the ear canal. The device is configured to be resistant to water and cerumen ingress into microphone components. The device comprises the microphone assembly described in the above paragraph, a receiver assembly and a battery assembly. The receiver assembly is configured to supply acoustical signals received from the microphone assembly to a tympanic membrane of a wearer. The battery assembly is configured to power the hearing device and is electrically coupled to at least one of the microphone assembly or the receiver assembly. At least one sealing retainer can be coupled to at least one of the microphone assembly or the receiver assembly.

BRIEF DESCRIPTION OF THE DRAWINGS

FIG. 5A is a perspective view illustrating an embodiment of a ring shaped barrier structure FIG. 5B is a lateral view illustrating an embodiment of a ring shaped barrier structure; FIG. 5C illustrate the circular cross section of the barrier.

FIG. 6A illustrates embodiment of the microphone assembly in close proximity to a battery surface, FIG. 6B illustrates a water droplet constrained between the two surfaces, FIG. 6C illustrates a barrier structure attached to the microphone assembly; and FIG. 6D illustrate the effect of the barrier structure in preventing water ingress into a microphone port.

DETAILED DESCRIPTION OF THE INVENTION

Various embodiments of the invention provide devices, assemblies and methods for improving the moisture and debris resistance of hearing aid microphones and other components used in completely in the canal (CIC) hearing aids. Specific embodiments provide barrier structures and other means for preventing or substantially reducing the ingress of liquids and other contaminates into hearing microphone ports and other hearing aid electronic components used in CIC hearing aids.

Figure 1:
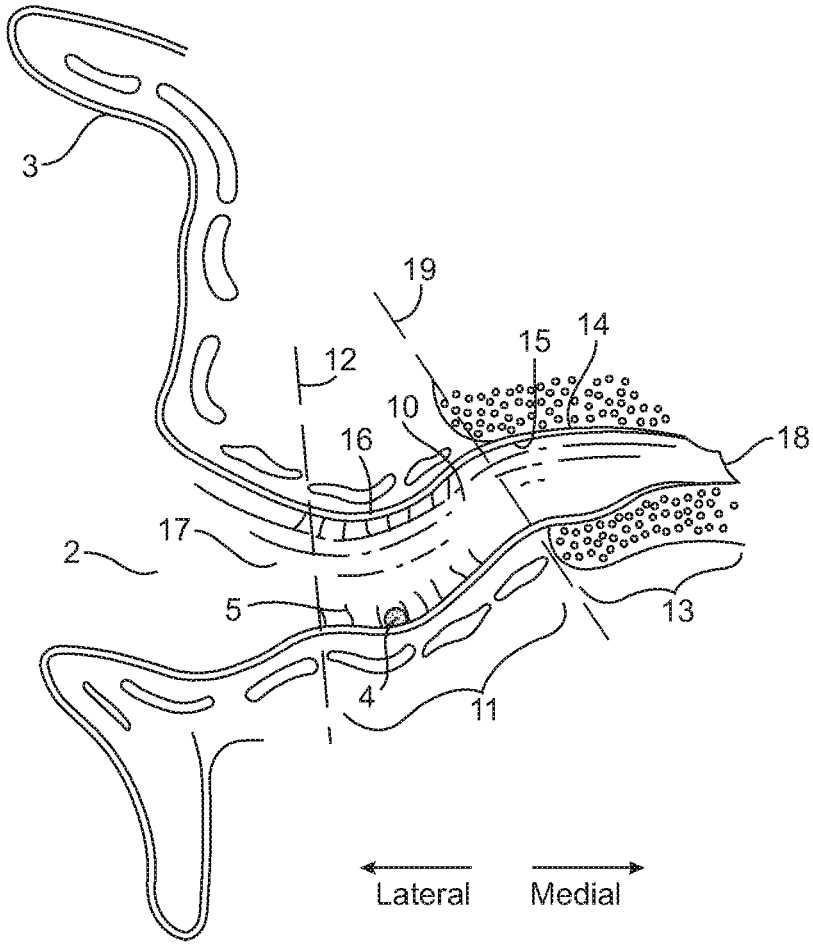
FIG. 1 is a side coronal view of the external ear canal.
Figure 2:
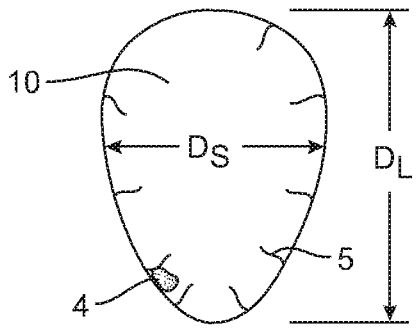
FIG. 2 is a cross-sectional view of the ear canal in the cartilaginous region.
Figure 3:
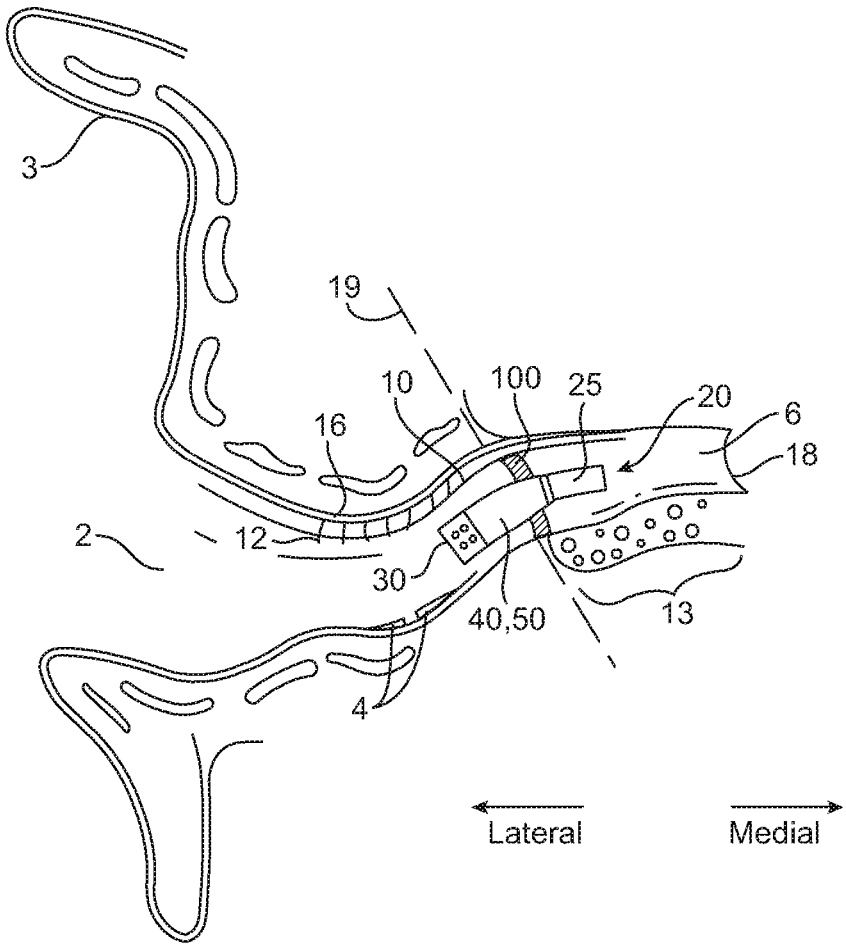
FIG. 3 is a lateral view illustrating an embodiment of a hearing aid device positioned in the bony portion of the ear canal.

Referring now to FIGS. 3-4, an embodiment of a CIC hearing aid device 20 configured for placement and use in ear canal 10 can include a receiver (speaker) assembly 25, a microphone assembly 30, a battery assembly 40 and one or more sealing retainers 100 coaxially positioned with respect to receiver assembly 25 and/or microphone assembly 30. Receiver assembly 25 is configured to supply acoustical signals received from the microphone assembly to a tympanic membrane of the wearer of the device. Preferably, device 20 is configured for placement and use in the bony region 13 of canal 10 so as to minimize acoustical occlusion effects due to residual volume 6 of air in the ear canal between device 20 and tympanic membrane 18. The occlusion effects are inversely proportion to residual volume 6; therefore, they can be minimized by placement of device 20 in the bony region 13 so as to minimize volume 6.

Figure 4A:
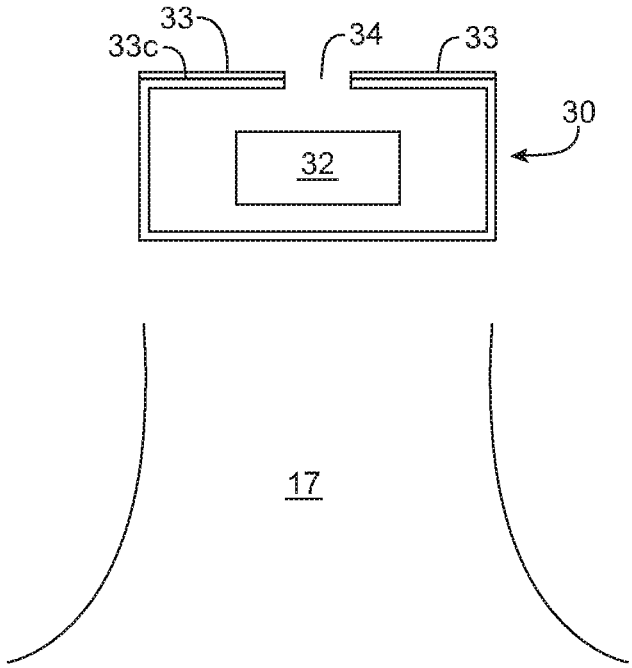
FIG. 4A is a cross-sectional view illustrating an embodiment of the hearing aid microphone assembly.

As shown in FIG. 4A, microphone assembly 30 includes a microphone housing 31 enclosing a microphone 32. Port 34 is configured to conduct sound to microphone 32. Housing 31 has a top surface 33 with a microphone port 34. In the embodiment shown, microphone port 34 faces away from canal aperture 17. This orientation serves to reduce the amount of liquids, cerumen and other contamination that can migrate through canal 10 and enter port 34. The performance of hearing aid 20 is not compromised in this configuration in that: 1) the microphone is still in direct acoustic communication with ambient air and thus ambient sounds; 2) the microphone uses the ear and/or the ear canal as a parabolic microphone to concentration sound reaching the microphone. Other means for providing moisture and contaminant protection of assembly 30 can include the use of a smooth hydrophobic coating 33*c* on surface 33. Suitable hydrophobic coatings include parylene which can be applied using vacuum coating methods known in the art. During the coating process, port 34 is preferably masked off to prevent obstruction of the port by the coating.

Figure 4B:
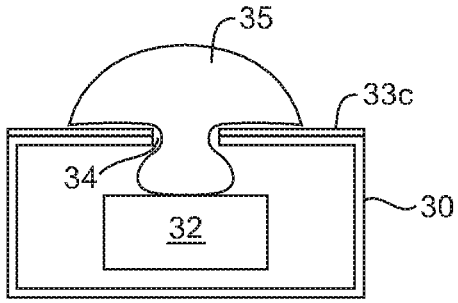
FIG. 4B is a cross-sectional view illustrating the wetting of the microphone port of the microphones assembly by a water droplet
Figure 4C:
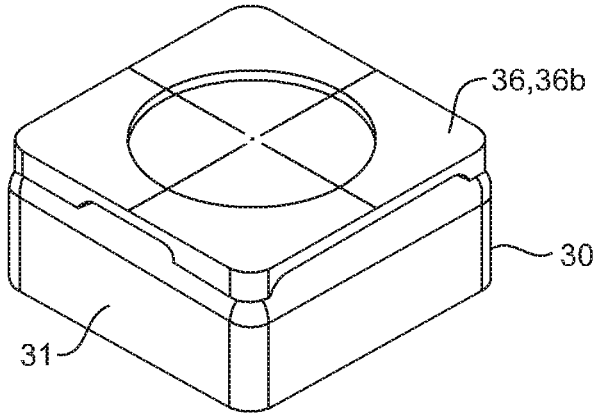
FIG. 4C is a perspective view illustrating an embodiment of hearing aid microphone assembly having a barrier structure.
Figure 4D:
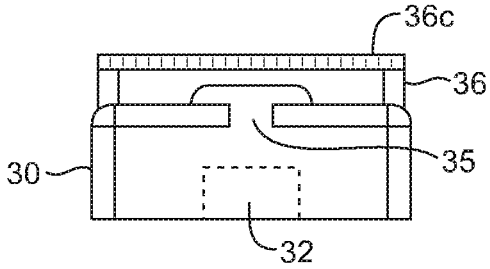
FIG. 4D is a lateral view illustrating use of the barrier structure in protecting the microphone port from wetting or ingress of water droplets or other liquids.

Despite the use of a hydrophobic coating, as shown in FIG. 4B, water or other aqueous droplets 35 sitting on surface 33 can still be drawn into port 34 (e.g. it wets the port) due to capillary attraction (e.g. adhesive forces between the liquid and the port which exceed the cohesive forces within the droplet). This can occur even if surface 33 is hydrophobic since port 34 must be necessarily uncoated to allow sound into the housing and the edges of port 34 serve to break up or disrupt the cohesive forces in the droplet. As shown in FIGS. 4C-D, in various embodiments, liquid ingress or wetting of the port 34 can be prevented or minimized by use of a barrier structure 36 which surrounds the port and acts as a fluidic barrier 36*b* to channel or redirect liquids away from port 34.

Barrier structure 36 can be attached to surface 33 using an adhesive known in the art or alternatively can be integral to surface 33. Preferably, barrier structure 36 is hydrophobic or has a hydrophobic coating 36*c* over all or least a portion of the barrier, in particular, the portions of the barrier which are exposed to fluids. Preferably, coating 36*c* is parylene but can also include fluoro-polymers coatings. Parylene coating of barrier 36 and surface 33 provides a low surface energy, water-repelling protective layer. In particular, parylene coating of surface 33 provides a smooth hydrophobic surface which minimizes capillary attraction to the surface. The thickness of both coatings 33*c* and coating 36*c* can be in the range of 1 to 30 microns, with specific embodiments of 10, 20 and 25 microns.

Figure 5A:
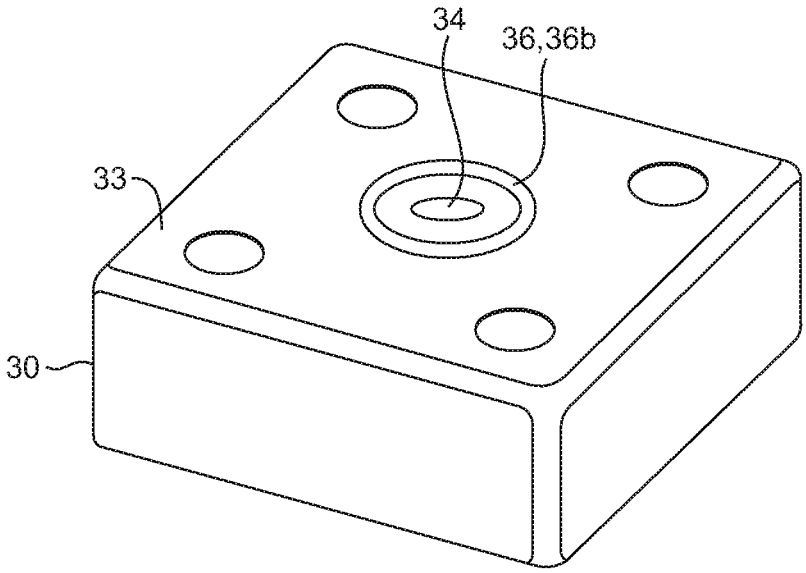
FIGS. 5A-5C illustrate embodiments of the barrier structure.
Figure 5C:
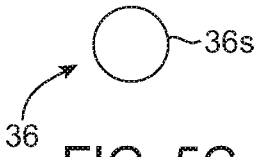
Figure 5B:
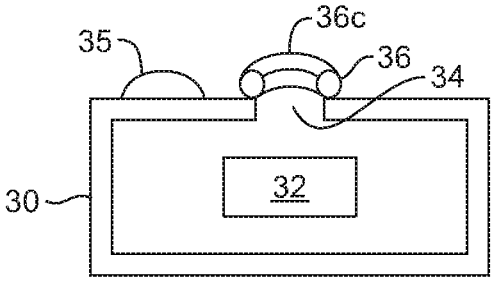
Figure 6A:
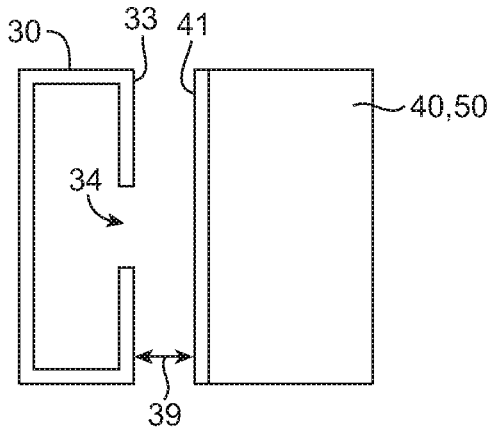
FIGS. 6A-6D are side views illustrating the microphone assembly.
Figure 6B:
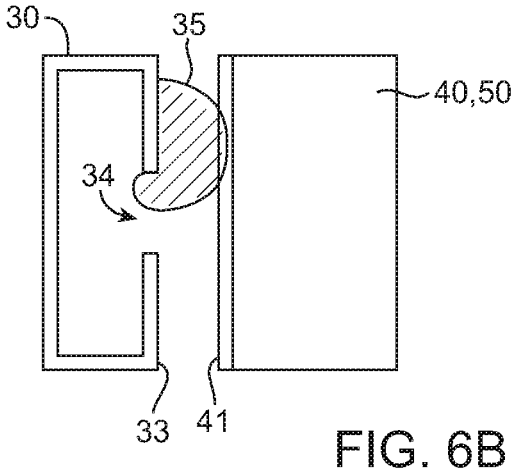
Figure 6C:
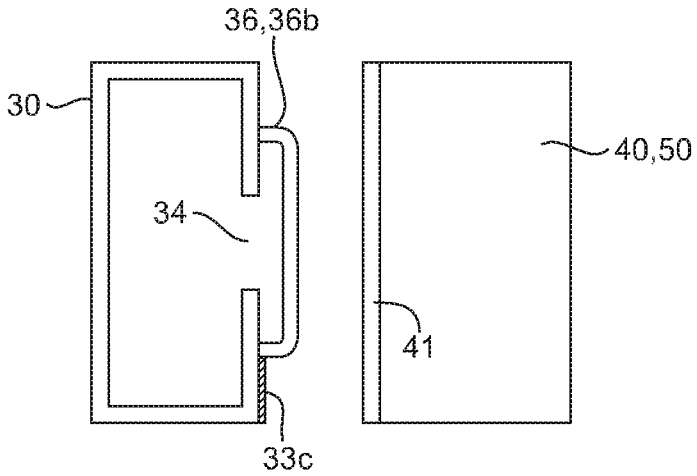
Figure 6D:
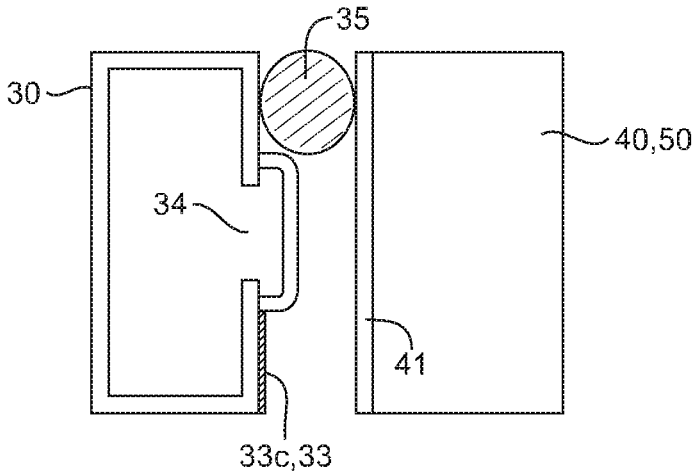

Referring now to FIGS. 5A-5C, in one embodiment, barrier structure 36 is ring shaped with a circular cross section 36*s* to minimize edges or other surface irregularities which can disrupt cohesive forces in the water droplet and potentially cause capillary attraction. By having a hydrophobic coating and minimal edges, barrier structure 36 can act as both a physical fluidic barrier and a hydrophobic barrier to channel and/or repel water droplets away from port 34 since it is energetically unfavorable for water to wet or otherwise cross over barrier structure 36. Barrier structure 36 can be fabricated from metal wire, various moldable polymers known in the art, or gasket material, e.g. silicone rubber. If not hydrophobic already, the materials comprising structure 36 can be treated using methods known in the art so as to have a hydrophobic s coating 36*c*. Examples of hydrophobic treatments include plasma treatments and chemical vapor deposition.

Referring now to FIGS. 6A-6D, in various embodiments, assembly 30 including surface 33 can be sized and/or otherwise configured to be in close proximity with another component of hearing aid 20 such as battery assembly 40. In particular embodiments, housing 31 including surface 33 is sized to be in close proximity with a surface 41 of battery assembly 40, such that there is a narrow gap 39 between the two surfaces. Surface 41 can include a battery barrier 60, such a hydrophobic barrier described in concurrently filed application Ser. No. 60/696,276, which is fully incorporated by reference herein. The lateral gap distance 39*d* between surface 33 and surface 41 can be in the range of 0.001 to 0.020 inches with specific embodiments of 0.005, 0.010 and 0.015 inches. Water droplets entering gap 39 will be at least partially constrained between the two surfaces. This may force droplets 35 into port 34, even if the two surfaces are hydrophobic. However, use of barrier structure 36 can prevent or substantially reduce the likelihood of water or other liquid entering into port 34 by channeling water around the port and/or making it more energetically favorable for a droplet to exit out of the sides of the gap rather than into port 34. In this later sense, the barrier serves to hydrophobically channel the fluid around the port. As a further safeguard against liquid or particle entry into port 34, in various embodiments, barrier structure 36 can include a mesh 37 discussed herein (see below).

Referring now to FIGS. 7A-7I, in many embodiments, barrier structure 36 can include a porous barrier 37 to protect port 34 and/or microphone 32 from various contaminants such as cerumen, sloughed skin and other biological matter. In various embodiments porous barrier 37 can comprise a mesh, a porous membrane or other porous structure. For ease of discussion, porous barrier 37 will now be referred to as mesh 37, but all other embodiments are equally applicable. Mesh 37 can be attached to the top portion of barrier structure 36 and can include hydrophobic coating 37*c*. In embodiment having mesh 37, barrier structure 36 can be configured as a mesh support structure. Alternatively, mesh 37 can be attached to another suitable support structure or can be attached directly to surface 33 or portion of microphone assembly 30. Mesh 37 will typically be circular or oval shaped but can also have other shapes, such as rectangular, etc. In specific embodiments, mesh 37 is configured to substantially prevent cerumen and other contaminant particles from entering into the microphone port without significantly effecting acoustical input into the microphone and/or the performance parameters of hearing device 20. Such performance parameters can include for example, speech and other sound recognition, frequency response, bandwidth, etc. Typically, mesh 37 will include a plurality of pores 37*p*. In one embodiment, mesh 37 has a pore size 37*ps* configured to substantially prevent cerumen particles from entering or clogging port 34 with minimal attenuation of incoming sound waves entering housing 31, so as to not compromise one or more acoustical performance parameters of hearing aid 20. Such performance parameters can include the gain, frequency response, bandwidth or speech recognition capability of the device. In related embodiments, the mesh can be configured such that there is minimal attenuation of one or more such parameters when up to approximately 75% of the pores become clogged or otherwise occluded (i.e., 25% patentcy). Such acoustical properties can be achieved through the selection of one or more of pore size, pore density, porosity and mesh thickness. The pores size 37*ps* of mesh 37 can range from about 0.1 to 20 microns with specific embodiments of 0.25, 0.5, 1, 5, 14 and 15 microns. Also the thickness 37*t* of membrane 37 can range from about 1 to 10 microns with specific embodiments of 2, 5, 6 and 8 microns. Additionally, mesh 37 is desirably configured to have minimal acoustical vibration over the frequency range of audible sound. In specific embodiments, the mesh is configured to be mechanically over-damped or otherwise have no resonant frequencies over the frequency range of audible sound. Such acoustical properties can be achieved through selection of one or more of the mesh material, fiber or film thickness, pore size, pore density, porosity and methods for attaching the mesh. (e.g., use of adhesives, etc.).

Mesh 37 can be attached to barrier structure 36 using adhesives or other joining methods known in the art, e.g. ultrasonic welding, hot melt junctions etc. The mesh can be fabricated from a number of polymers and/or polymer fibers known in the art including polypropylene, polyethylene terephthalate (PET), fluoro-polymers NYLON, combinations thereof, and other filtering membrane polymers known in the art. In a preferred embodiment, mesh 37 is fabricated from polycarbonate fibers. Hydrophobic coating 37*c* can include fluoro-polymers, silicones and combinations thereof. Also, all or portion, of mesh 37 can be fabricated from hydrophobic materials known in the art such as fluoro-polymer fibers, e.g., expanded PTFE.

Figure 7A:
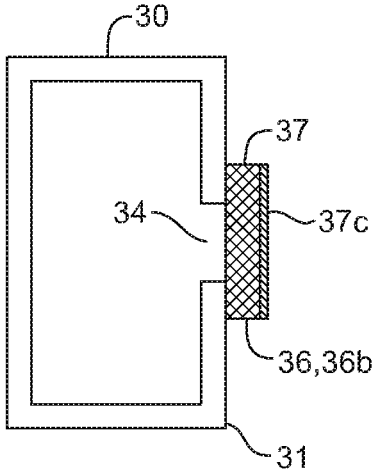
FIG. 7A is a later view illustrating an embodiment of hearing aid microphone assembly having a barrier structure including a protective mesh.
Figure 7B:
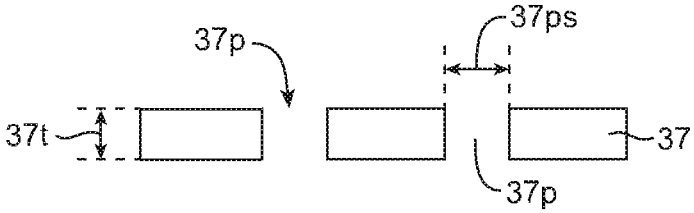
FIG. 7B is a lateral view illustrating dimensional properties of the mesh.
Figure 7C:
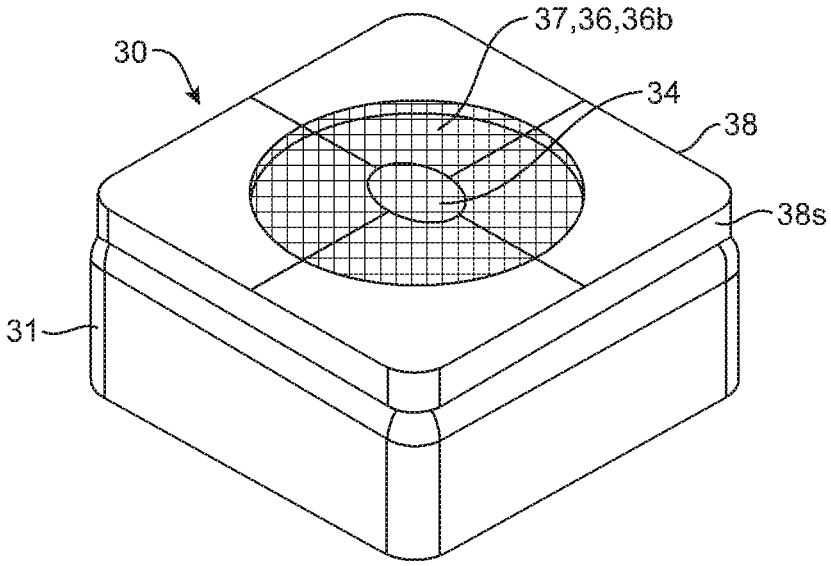
FIG. 7C is a perspective view illustrating an embodiment of hearing aid microphone assembly having a protective mesh and a mesh holder.

In various embodiments in which the microphone assembly includes a mesh, the mesh can be attached to microphone assembly 30 using a mesh holder 38. In many embodiments, mesh holder 38 is one in the same as barrier structure 36 or is otherwise configured to function as a barrier structure. In an embodiment shown in FIG. 7C, mesh 37 is attached to assembly 30 using a mesh holder 38 attached to assembly 30. Mesh holder 38 can comprise a fitting such as a plastic fitting, or other fitting known in the art. Typically, mesh holder 38 will be square or rectangular shaped as is shown in the embodiment in FIG. 7C. However, the mesh holder can have a round, oval, or other shape. Mesh holder 38 can have substantially the same shape and size as that of mesh 37 or can be under or over sized. In one embodiment, the mesh is circular shaped and is circumscribed by a larger square shaped mesh holder as is shown in FIG. 7C.

Figure 7D:
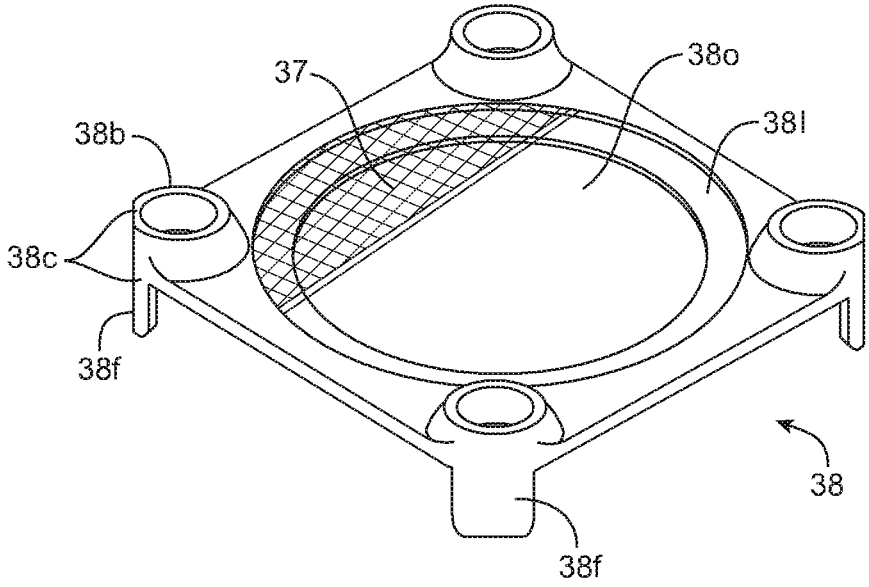
FIG. 7D is a perspective view illustrating an embodiment of the mesh holder.
Figure 7E:
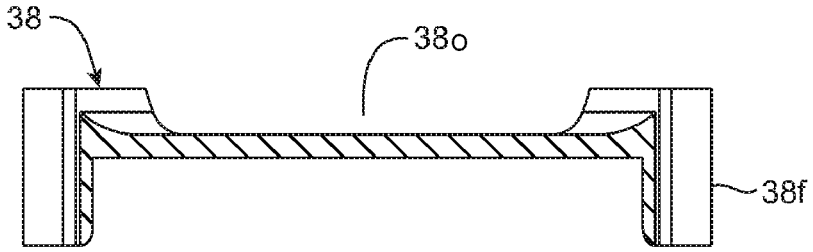
FIG. 7E is a side view illustrating an embodiment of the embodiment of FIG. 7D.
Figure 7F:
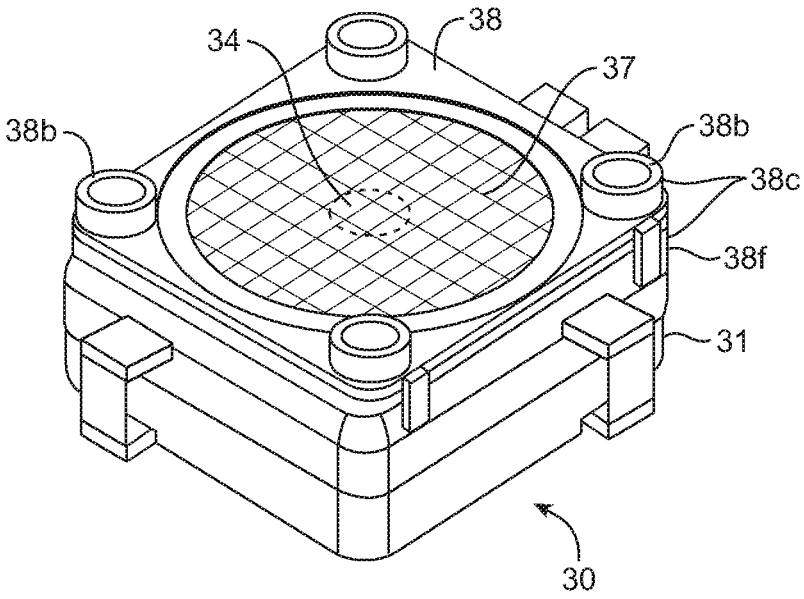
FIG. 7F is a perspective view illustrating an embodiment of the mesh holder of FIG. D mated with an embodiment of the microphone assembly.

FIGS. 7D-7F show a preferred embodiment of mesh holder 38 that is configured to be coupled with microphone assembly 30. In this and related embodiments, mesh holder 38 is configured to mate or otherwise engage with the surface 33 of microphone assembly 30 via fittings or other attachment means 38*f*. The holder includes a mesh opening 38*o* and a recessed lip 38*l* on which mesh 37 rests and is attached by means of an adhesive or other attachment means. Lip 38*l* serves to raise mesh 37 off of assembly surface 33 by selected amount or offset so as to define an air space or volume as is described below. In many embodiments, opening 38*o* is circular shaped and thus lip 38*l* is ring shaped. In other embodiments, opening 38*o* can be oval or rectangular shaped with lip 381 having a matching shape.

Fittings 38*f* can be configured to be snap fit or otherwise mated to the corners or other portions of assembly 30. Holder 38 can also include one or more bosses 39*b* configured to mate with features (not shown) on battery assembly 40. Each fitting 38*f* can include a corresponding boss or raised portion 38*b* and together, fitting 38*f* and boss 38*f* can comprise an integral attachment structure 38*i*. Structure 38*i* can have a shape and mechanical properties to act as a load bearing structure configured to transfer and bear the bulk of any compressive forces between microphones assembly 30 and battery assembly 40 such that mesh 37 is not compressed, is not put in compression or otherwise not deformed due to compressive or other forces exerted by the microphone or battery assemblies. Such forces may occur during insertion of hearing device 20 or subsequent repositioning due to jaw and head movement. In particular embodiments structure 38*i* has sufficient column strength to prevent compressive deformation or displacement of mesh 37 or otherwise preserve a spacing or gap (not shown) between the microphone assembly 30 and battery assembly 40 during insertion or movement of hearing device 20.

Figure 7G:
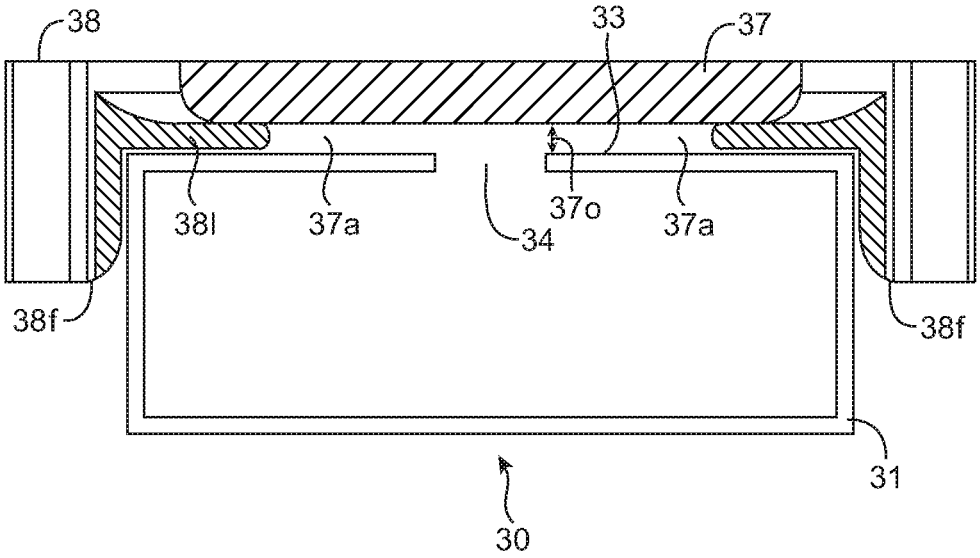
FIG. 7G is a lateral view illustrating an embodiment of hearing aid microphone assembly having a mesh holder configured to hold the mesh at an offset from surface of the microphone assembly to produce an airspace between the mesh and the surface.
Figure 7H:
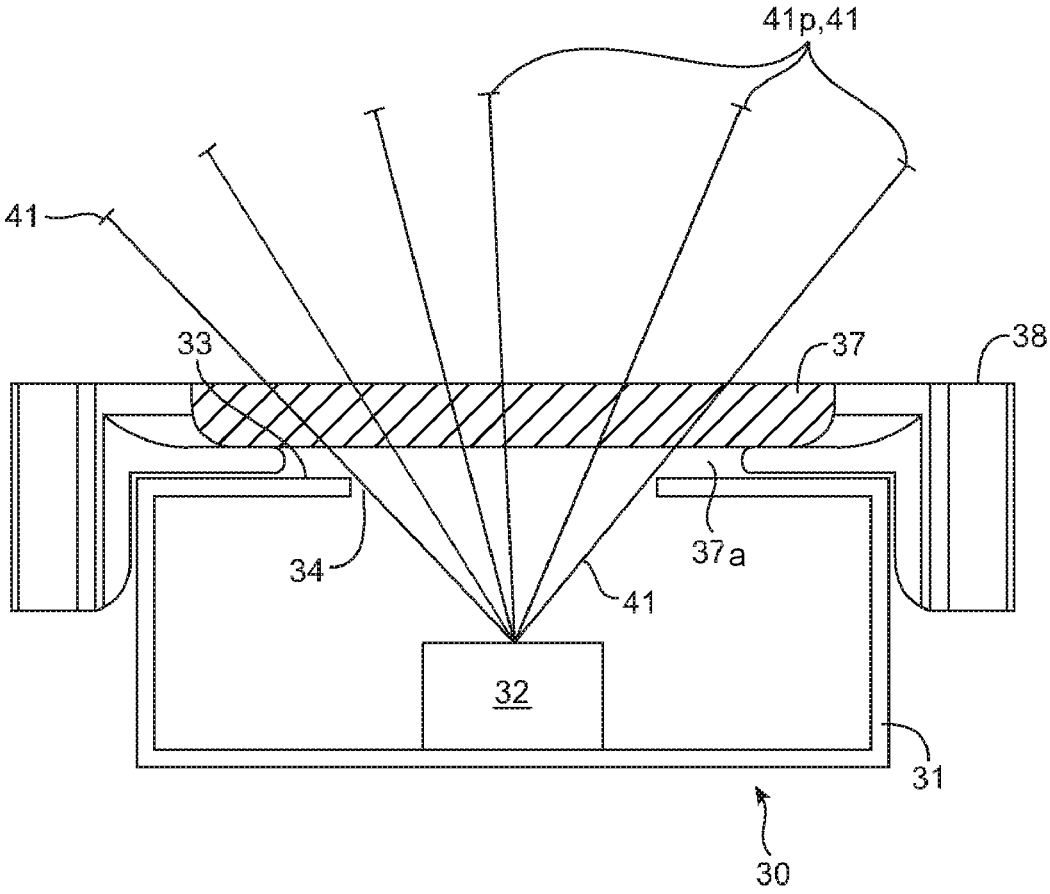
FIG. 7H is a lateral view illustrating a plurality of pathways for acoustical conduction to the microphone port created by the airspace in the embodiment of FIG. 7D.
Figure 7I:
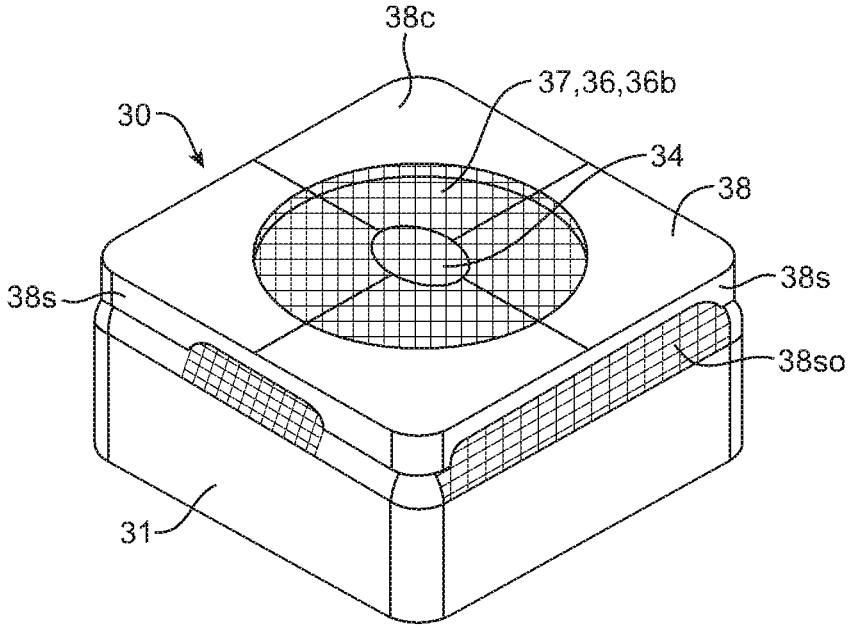
FIG. 7I is a lateral view illustrating an embodiment of hearing aid microphone assembly having a protective mesh and a mesh holder having side openings.

In a preferred embodiments, holder 38 is configured to hold mesh 37 at an offset 37*o* from surface 33 of the microphone assembly 30 such that an airspace or volume 37*a* exists between surface 33 and mesh 37 as is shown in shown in FIG. 7G. The amount of offset 37*o* can range from about 0.0001" to 0.005" with specific embodiments of 0.0005" and 0.001". Air space 37*a* serves to facilitate the conduction of sound to the microphone port 34. Also, it improves the ability of the mesh to conduct sound to the microphone when portions of the mesh become fouled with cerumen or other contaminants. As is shown in FIG. 7H, this is achieved in part, by the air space 37*a* providing a plurality 41*p* of pathways 41 for acoustical conduction to the port 34 such that if one or more paths 41 are obstructed by contaminants, there is a sufficient number of patent paths to achieve a minimum level of acoustical conduction to the microphone port so as to operate the hearing aid without a significant detrimental effect on hearing aid performance. Further, the air space 37*a* also provides one or more non-linear paths of acoustical conduction to the microphone port to allow for acoustical conduction to microphone port 34 and microphone 32 when portion of the mesh become fouled. In theses and similar respects, air space 37*a* confers upon microphone assembly 30, a level of fault tolerance to fouling by cerumen or other contamination.

Holder 38 can be attached to assembly 30 using adhesive bonding, ultrasonic welding, heat staking or other attachment means known in the art. In one embodiment, holder 38 is adhesively bound to a lip 381 of holder 38. Preferably, holder 38 is solid on all sides 38*s*, as is shown in FIG. 7C and is mounted flush with the surface 33 of microphone assembly 34. Alternatively, one or more portions of holder 38 can be partially open. For example, in the embodiment shown in FIG. 7I, holder 38 can have one or more openings 38*so* in side portions 38*s*. Holder 38 can be fabricated using plastic injection molding techniques known in the art. All or a portion of holder 38 can include a hydrophobic coating 38*c* such as those described herein. Mesh 37 can be press fit into holder 38 and held in place by adhesive or an interference fit. Alternatively, holder 38 can comprise snap fit and like components that are snap fit or otherwise joined together to at least partially surround mesh 37. Similar to mesh 37, holder 38 is desirably configured to be mechanically over damped or otherwise have no resonant frequencies over the frequency range of audible sound. In various embodiments, mesh 37 and mesh holder 38 can be tested as an assembled unit to assure that it is over-damped or otherwise does not have any resonant frequencies over a selectable range of audible frequencies.

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in the hearing aid device fields as well as other fields which will be recognized by practitioners skilled in the art.

Elements, characteristics, or acts from one embodiment can be readily recombined or substituted with one or more elements, characteristics or acts from other embodiments to form numerous additional embodiments within the scope of the invention. Hence, the scope of the present invention is not limited to the specifics of the exemplary embodiment, but is instead limited solely by the appended claims.

What is claimed is:

1. A microphone assembly for a CIC hearing aid, the assembly comprising:

a microphone housing including a housing surface having a microphone port, the microphone housing sized to be positioned in close proximity to another hearing aid component surface, the port configured to conduct sound to a microphone device positioned within the housing; and a protective porous barrier supported over the microphone port, the porous barrier having a pore size configured to substantially prevent entry of cereumn particles into the port while allowing conduction of incoming acoustical signals to the port with minimal attenuation when up to 75% of the porous barrier is occluded.

2. The microphone assembly of claim 1, wherein a hearing aid output is not appreciably affected when up to 75% of the porous barrier is occluded.

3. The microphone assembly of claim 1, wherein the porous barrier is a mesh.

4. The microphone assembly of claim 1, wherein the porous barrier is supported by a support structure coupled to the housing.

5. The microphone assembly of claim 4, wherein the support structure surrounds the microphone port.

6. The microphone assembly of claim 4, wherein at least a portion of the support structure is hydrophobic.

7. The microphone assembly of claim 4, wherein the support structure comprises a fluidic barrier.

8. The microphone assembly of claim 4, wherein the support structure has a shape configured to minimize capillary attraction of liquids.

9. The microphone assembly of claim 4, wherein the support structure has an ring or a rectangular shape.

10. The microphone assembly of claim 1, wherein at least a portion of the porous barrier is hydrophobic.

11. The microphone assembly of claim 1, wherein a distance between the housing surface and the another surface is less than about 0.020 inches.

12. The microphone assembly of claim 1, wherein the another component surface is battery assembly surface or a hydrophobic surface.

13. The microphone assembly of claim 1, wherein the at least a portion of the housing comprises a hydrophobic coating, fluoro-polymer coating or a parylene coating.

14. The microphone assembly of claim 1, wherein a pore size of the porous barrier is about 14 microns.

15. The microphone assembly of claim 1, wherein a thickness of the porous barrier is about 6 microns.

16. The microphone assembly of claim 1, wherein the porous barrier is configured to be mechanically over damped over the range of audible frequencies.

17. A CIC hearing aid device for operation in the bony portion of the ear canal, the device being resistant to water and cerumen ingress into microphone assembly components, the device comprising:

the microphone assembly of claim 1;

a receiver assembly configured to supply acoustical signals received from the microphone assembly to a tympanic membrane of a wearer; and a battery assembly for powering the device, the battery assembly electrically coupled to at least one of the microphone assembly or the receive assembly, the battery assembly having a surface comprising the another component surface.

18. A microphone assembly for a CIC hearing aid, the assembly comprising:

a microphone housing including a housing outer surface and a microphone port extending through the housing outer surface, the microphone housing sized to be positioned in close proximity to another hearing aid component surface, the port configured to conduct sound to a microphone device positioned within the housing; and a protective porous barrier supported over the microphone port at an offset from the housing outer surface, the offset defining an air volume between the housing outer surface and the porous barrier that conducts sound to the microphone port, the porous barrier having a pore size configured to substantially prevent entry of cereumn particles into the port while allowing conduction of incoming acoustical signals to the port with minimal attenuation when up to 75% of the porous barrier is occluded.

19. The microphone assembly of claim 18, wherein the air volume provides a plurality of pathways for acoustical conduction to the microphone port.

20. The microphone assembly of claim 19, wherein the plurality of pathways maintains a level of acoustical conduction to the port when up to 75% of the porous barrier is occluded.

21. The microphone assembly of claim 18, wherein the air volume provides a non-linear path of acoustical conduction to the microphone port.

22. The microphone assembly of claim 18, wherein the microphone port defines a perimeter, the air volume defines a perimeter, and the perimeter of the air volume is greater than the perimeter of the microphone port.

23. The microphone assembly of claim 18, wherein the microphone port defines a width, the air volume defines a width and a thickness, and the width of the air volume is greater than the width of the microphone port.

24. The microphone assembly of claim 18, wherein the offset ranges from 0.0001 inch to 0.005 inch.

25. The microphone assembly of claim 24, wherein the offset ranges from 0.0005 inch to 0.001 inch.

26. A method for protecting a hearing aid microphone assembly from moisture, the method comprising:

positioning a hearing aid in the ear canal of user, the hearing aid comprising a microphone assembly comprising a microphone housing including a housing outer surface and a microphone port extending through the housing outer surface, the microphone housing sized to be positioned in close proximity to another hearing aid component surface, the port configured to conduct sound to a microphone device positioned within the housing; and a porous barrier supported over the microphone port so as to define an air volume between the porous barrier and the microphone port which provides a plurality of pathways of acoustical conduction to the microphone port; and utilizing the plurality of pathways provided by the air volume between the porous barrier and the microphone port to maintain a level of acoustical conduction to the port when up to 75% of the porous barrier is occluded.

27. The method of claim 26, wherein at least a portion of the pathways to the microphone port are non-linear.

* * * * *